United States Patent [19]

Dean

[11] Patent Number: 4,572,327

[45] Date of Patent: Feb. 25, 1986

[54] SOUND ATTENUATOR

[75] Inventor: Raymond H. Dean, Shawnee Mission, Kans.

[73] Assignee: Tempmaster Corporation, North Kansas City, Mo.

[21] Appl. No.: 668,952

[22] Filed: Nov. 7, 1984

[51] Int. Cl.[4] ..... E04B 1/82

[52] U.S. Cl. ..... 181/295; 181/224; 98/DIG. 10

[58] Field of Search ..... 181/211, 224, 227, 286, 181/295, 30; 98/1, DIG. 10

[56] References Cited

U.S. PATENT DOCUMENTS 3,568,791 3/1971 Luxton ..... 181/224

4,068,736 1/1978 Dean et al. ..... 181/224

*Primary Examiner*—Benjamin R. Fuller

*Attorney, Agent, or Firm*—Kokjer, Kircher, Bradley, Wharton, Bowman & Johnson

[57] ABSTRACT

A sound attenuator formed by a bank of at least three wall mounted tubes extending into a room from which noise originates and also into an adjacent occupied room. Each tube is cylindrical and has a length between one sixth and one third wavelength of sound in air at the highest frequency in the low frequency waveband in which the reactive acoustical properties of the tubes are effective. The diameter of each tube is less than about one sixth wavelength. The size, arrangement and spacing of the tubes are selected to take good advantage of the operative acoustical phenomena, including the quarter wavelength effect, the duct end loss effect and the multiple tube effect.

20 Claims, 3 Drawing Figures

SOUND ATTENUATOR

BACKGROUND OF THE INVENTION

This invention relates generally to the field of noise attenuation and deals more particularly with a sound attenuator used to prevent low frequency noise from being transmitted from equipment rooms and other noisy areas into occupied spaces.

In the air distribution systems of office buildings, commercial buildings and other large building, the air ducts and particularly the return ducts are a major source of low frequency noise. This problem is particularly noticeable in occupied spaces located near an equipment room. The air handling and refrigeration machinery generates low frequency sounds which originate in the equipment room and travel into the occupied space via the return air path. The occupied spaces closest to noise generating equipment are most subject to this type of noise problem.

High frequency noise (above about 500 Hz) can be successfully attenuated by conventional techniques such as the use of duct liners and suitable terminal units. Lower frequencies in the second, third and fourth octave bands (125 Hz, 250 Hz and 500 Hz) can be effectively absorbed by modules of the type shown in U.S. Pat. No. 4,068,736 to Dean et al. This type of sound absorber is particulrly effective in the third and fourth octave bands and also functions better than other devices in the second octave band. However, in the first octave band (63 Hz), neither the patented module described in the aforementioned Dean et al. patent nor any other known sound absorber provides more than a small amount of sound absorption, and frequencies below about 100 Hz remain a significant problem.

Sound absorbers have been used in the past both in through-the-wall applications and in-duct applications, although in-duct installations have been much more common. It has been assumed that the attenuation does not differ significantly whether the sound absorber is used in a through-the-wall application or an in-duct application, so long as proper design parameters are used. This assumption is valid at high frequencies and also at low frequencies in most cases. However, we have found that a through-the-wall application can achieve some additional and unexpected attenuation at low frequencies by taking advantage of a phenomenon known as "end reflection loss". This phenomenon results in the reflection of a certain amount of sound back into a duct when a sound wave passes from the duct into a much larger space such as a room. However, as indicated on page 32.11 of the 1984 ASHRAE Guide on Systems in the section on "Sound and Vibration Control", this occurs only if the duct termination is preceded by a straight section of ductwork which is 3 to 5 duct diameters long and which lacks a diffuser or grille.

SUMMARY OF THE INVENTION

The present invention provides a particularly effective low frequency noise attenuator which takes advantage of the "duct end reflection loss" and other acoustical phenomena to inhibit the transmission of low frequency noise (55 Hz to 110 Hz) from a noise source such as an equipment room into an occupied space.

In accordance with the invention, a bank of at least three tubes is mounted on the wall of the space containing the noise source. Although the tubes can be mounted on only one side of the wall, better results are achieved if each side of the wall is equipped with a bank of tubes. The tubes on the opposite sides of the wall are aligned, and each pair of aligned tubes contains a sound absorbing medium such as a module of the type described in the aforementioned Dean et al. patent. Preferably, the tubes are located above a false ceiling in the occupied room where they are completely hidden from view along with the ventilating ducts and other devices commonly extending above the ceiling.

Effective functioning of the tubes in the attenuation of low frequency noise requires that they be provided with the proper geometry, size, spacing and arrangement. Because the acoustical results are not affected greatly by relatively small dimensional variations, the dimensions need not be maintained within strict limits and can be varied somewhat without adversely affecting the performnce of the sound attenuator. If the dimensions and geometry are selected properly, the sound attenuator can function effectively over a broad waveband amd can provide substantially uniform noise attenuation over two full octaves. The inclusion of a sound absorbing medium in each tube enhances the ability of the sound attenuator to suppress noise within the targeted bandwidth and also broadens the width of the frequency waveband in which the device is effective.

DETAILED DESCRIPTION OF THE INVENTION

In the accompanying drawing which forms a part of the specification and is to be read in conjunction therewith and in which like reference numerals are used to indicate like parts in the various views.

Figure 1:
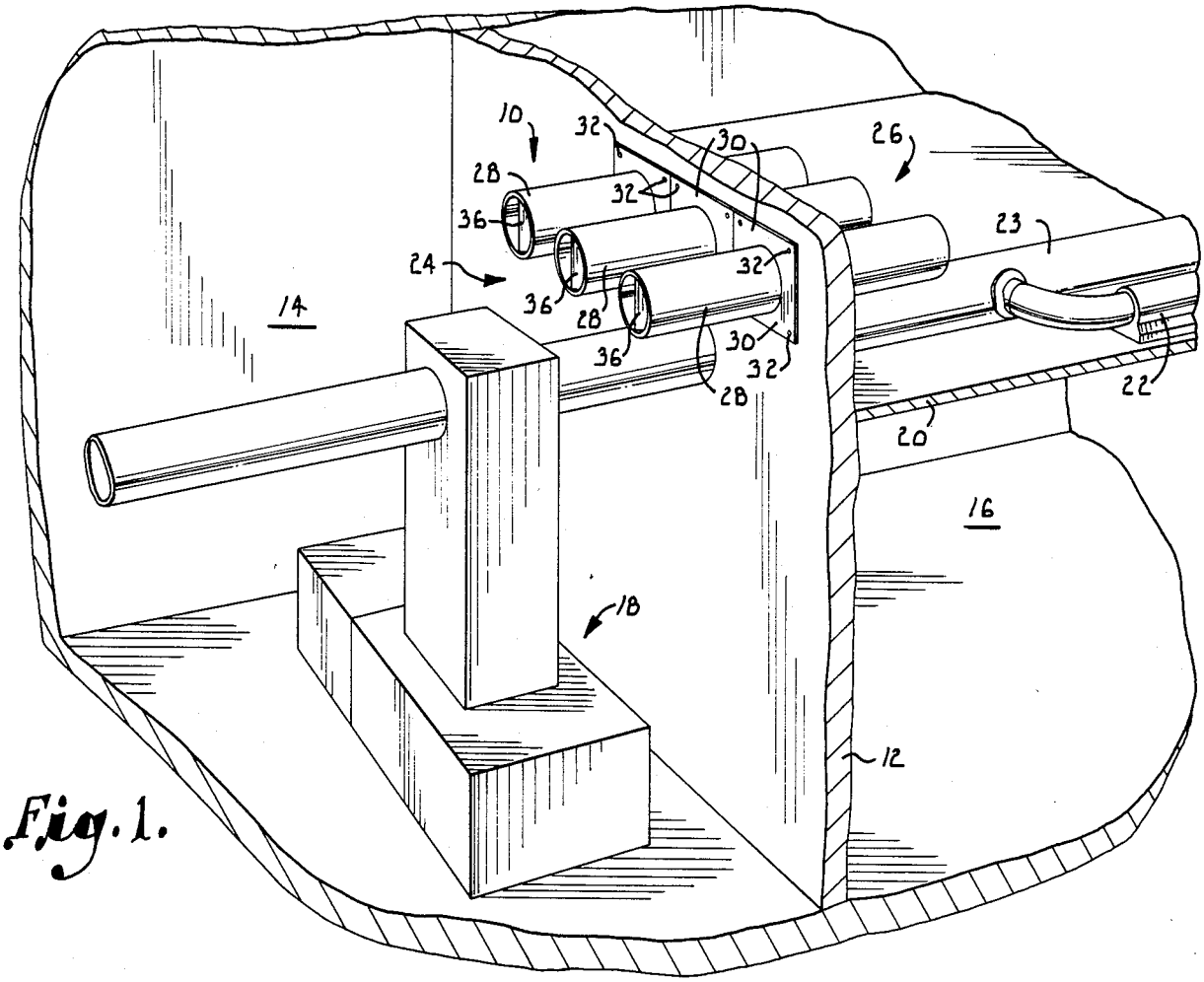
FIG. 1 is a fragmentary perspective view of a pair of adjacent rooms served by a return air duct and separated by a wall which is equipped with a sound attenuating device constructed according to a preferred embodiment of the present invention.
Figure 2:
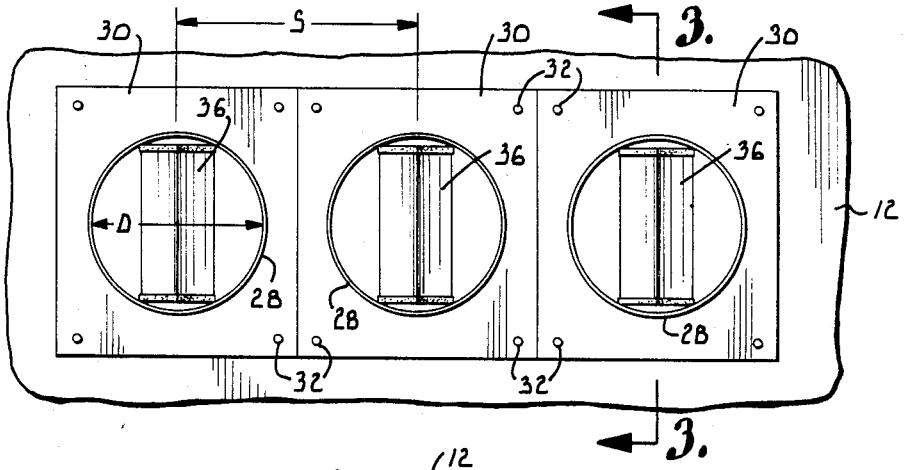
FIG. 2 is a fragmentary front elevational view on an enlarged scale showing the sound attenuating device mounted on the wall.

Referring now to the drawing in more detail and initially to FIG. 1, numeral 10 generally designates a through-the-wall sound attenuating device constructed in accordance with a preferred embodiment of the invention. The attenuating device 10 is typically installed on a wall 12 which separates an equipment room 14 from an occupied room 16 in which office work or other activity takes place. The wall 12 is typically about four inches thick. In the equipment room 14, noise generating machinery such as the air handling unit 18 produces noise during operation, and the noise often includes sound in the first octave band (63 Hz), as well as noise in the higher octave bands. The occupied room 16 has a "false" ceiling 20 equipped with one or more supply air registers 22. A supply duct 23 extends above the ceiling 20 and delivers supply air from the supply registers 22. The supply duct extends through the wall 12 from the air handling unit 18.

The sound attenuator 10 of the present invention includes a first tube array or bank 24 which projects from wall 12 into the equipment room and a second tube bank 26 which projects from wall 12 into the occupied room 16 at a location above ceiling 20. Each of the tube banks 24 and 26 includes at least three tubes 28, and all of the tubes are constructed identically. Each tube 28 is cylindrical and is open at both ends. On one end of each tube, a square mounting flange 30 is connected with the tube to facilitate mounting of the tube on the wall 12. The tubes 28 and flanges 30 may be constructed of sheet metal or another suitable material.

The tubes 28 in each bank are mounted on wall 12 by applying screws 32 or other suitable fasteners to the mounting flanges 30 and the wall. The tubes in the bank 24 are mounted on the wall surfaces which faces into the equipment room 14, while the tubes in bank 26 are mounted on the wall surface which faces into room 16. As previously indicated, the tubes in bank 26 are preferably located above the ceiling 20 where they are hidden from view.

Figure 3:
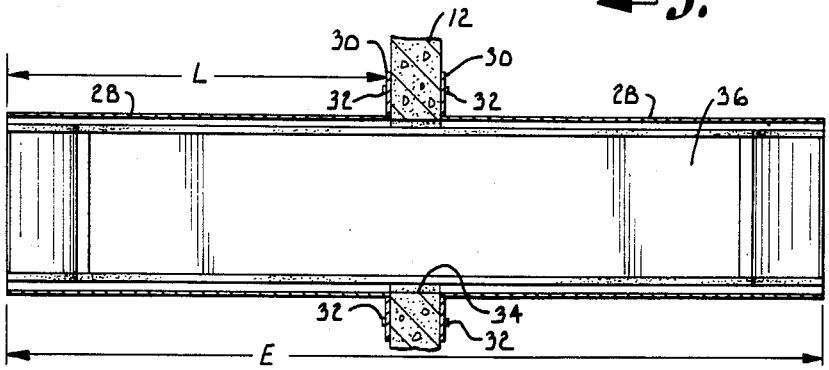
FIG. 3 is a fragmentary sectional view taken generally along line 3—3 of FIG. 2 in the direction of the arrows.

The flanges 30 are perpendicular to the longitudinal axes of the tubes, and the tubes are thus mounted perpendicular to the wall 12. The tubes 28 in each bank are located side by side and parallel to one another. An opening 34 is formed through the wall 12. As best shown in FIG. 3, the tubes in the two banks 24 and 26 are axially aligned with one another. A suitable fire damper (not shown) may be provided in each wall opening 34 if desired or if necessary to comply with fire codes.

A sound absorber 36 is preferably mounted in each pair of aligned tubes 28 to extend substantially the combined length of the tubes. The sound absorbers 36 may be of the type shown in U.S. Pat. No. 4,068,736 which issued to Dean et al. on Jan. 17, 1978 and which is incorporated by reference herein. Sheet metal screws (not shown) may be used to attach the sound absorbers 36 and the tubes 28.

In use, the sound attenuating device 10 acts to suppress low frequency noise in the waveband of about 55 Hz to about 110 Hz. The low frequency noise generated by the air handling unit 18 in the equipment room 14 is attenuated, and its transmission into the occupied room 16 is inhibited by the sound attenuator.

The sound attenuator 10 of the present invention takes advantage of several reactive acoustical properties, and the size, shape, spacing and physical arrangement of the tubes are selected to maximize the attenuation of noise in the low frequency waveband of interest. In accordance with the invention, the waveband of interest is selected to be from about 55 Hz to about 110 Hz, as previously suggested. By selecting the upper limit of the waveband to be approximately twice the lower limit and selecting the geometry such that the acoustical phenomena are particularly effective at the upper and lower limits of the bandwidth, a particularly broad-band sound absorber is constructed having an effective range of nearly two full octaves, from about half an octave below the lower limit of the bandwidth of interest to about half an octave above the upper limit of the bandwidth. Within this frequency range of approximately two full octaves, the sound absorber provides substantially uniform sound attenuation.

One acoustical phenomenon utilized by the sound absorber 10 is the "quarter wavelength effect". When low frequency sound waves are incident normally on a hard surface such as the wall 12, they reflect and create a pressure minimum at a distance of one fourth wavelength away from the reflective surface. Consequently each tube 28 in the bank 24 on the sound source side of the wall has a length L (see FIG. 3) of about one fourth wavelength of sound in air at the highest frequency of interest (110 Hz). This gives each tube in the source side bank a length of about 30 inches so that its open end is located about one fourth wavelength (at 110 Hz) away from the wall. The one quarter wavelength phenomenon is effective in the range of about one sixth wavelength to one third wavelength of sound in air at the upper limit 110 Hz frequency, so the tube length can vary between about 20 inches and about 40 inches and still take good advantage of the quarter wavelength effect.

Noise reduction at the exit or listener ends of the tubes can also be achieved by utilizing the quarter wavelength phenomenon. Consequently, the tubes 28 in the bank 26 should also have lengths between one sixth and one third wavelength of sound in air at 110 Hz (20 inches to 40 inches), with about one fourth wavelength (30 inches) preferred for each tube. This locates the open ends of the tubes 28 in the listener side tube bank 26 about one fourth wavelength from the wall 12 so that the first reflection of low frequency sound from the wall essentially cancels the low frequency sound which propogates out through the open ends of the tubes in bank 26.

The fact that the listener side tubes 28 are open ended also results in advantage being taken of the "duct end reflection loss" which, as indicated previously, causes a certain amount of sound being reflected back into the tubes. In order for this factor to contribute significantly to the sound attenuation, it is necessary for the cross sectional area of the listener side tubes 28 to be much less than the corresponding cross sectional dimensions of the space into which the sound waves pass from the tubes. The tubes of the present invention meet this criterion because the cross sectional area of each tube is small in comparison to the rooms 14 and 16, so benefits in sound attenuation result from the end reflection loss phenomenon.

The expansions that occur at the opposite ends of the tubes interact, and this interaction is most beneficial in attenuating low frequency sound when the expansions occur about one fourth wavelength apart. So long as the expansions at the opposite ends of the tubes are no more than about one third of a wavelength apart, beneficial effects are achieved from the interaction therebetween. Because the lowest frequency of interest is one half the highest frequency of interest, the tube ends are separated by about one fourth wavelength of sound in air at the lowest frequency of interest (55 Hz), as desired to achieve maximum end to end interaction (at 55 Hz), when each tube 28 has a length L of about one fourth wavelength of sound in air at the highest frequency of interest (the wall thickness of about 4 inches can be disregarded). To take good advantage of the end to end interaction of the tubes, the open ends should be spaced apart a distance E no more than about one third of a wavelength of sound in air at the lower limit frequency of the waveband, and one fourth wavelength (about 60 inches) is preferred.

A final acoustical phenomenon which benefits the sound suppressing characteristics of the present invention has been observed experimentally and results unexpectedly from what can be termed a "multiple tube effect". In essence, the multiple tube phenomenon is caused by the use of the three tubes in close proximity and the acoustical interaction among the tubes. Although more than three tubes can be used while still achieving the benefit of the multiple tube effect, less than three tubes causes a significant reduction in sound attenuation. Accordingly, at least three tubes should be included in the sound attenuator 10.

The multiple tube benefit is believed to result from the fact that most of the sound energy which is incident on the sound attenuator 10 travels in waves oblique to the surface of wall 12. Because the entrance ends of the tubes 28 in the source side bank 24 are spaced apart, each of these nonperpendicular sound waves has a different phase at the entrance of each tube. At low frequencies, all higher order or "cross" modes of propogation are evanescent and cannot propogate due to the relatively small size and round shape of the tubes. Consequently, all of the energy of the predominant oblique modes entering the tubes is converted to the perpendicular fundamental mode of propogation. Although the sound waves in different tubes travel in parallel, they are out of phase relative to one another. Thus, when the parallel but out of phase waves emerge from the exit ends of the tubes, their phases tend to cancel one another, and the net wave which is transmitted into the listener side of the wall is weaker than a normally incident wave on the source side of the wall. It has been experimentally observed that the multiple tube effect is so strong that the listener side of the wall is quieter when the three tube arrangement shown in the drawing is used than when only a single tube is used.

As previously indicated, the cross sectional area of each tube 28 is much smaller than the corresponding cross sectional dimensions of the rooms 14 and 16 with which the tubes are in communication. The diameter D of each tube should not exceed about one sixth wavelength of sound in air at the upper limit frequency of 110 Hz, or significant reductions in the reactive effects occur. That is, larger tubes lose the benefits of the duct end reflective loss and the multiple tube effect. Thus, the tube diameter D should be less than about one sixth wavelength of sound in air at the highest wavelength of the 55 Hz to 110 Hz waveband of interest. Tube diameters in the range of 14 to 22 inches have been used with good results. If a diameter less than about 14 inches is used, the sound absorber 36 unduly clogs up the tube.

The spacing between adjacent tubes 28 in the tube banks 24 and 26 cannot be too great or the benefits of the multiple tube effect will be lost. Conversely, the quarter wavelength effect is reduced or lost if the tubes are too close together. To assure that substantial benefits are obtained from the multiple tube effect at the lowest frequency in the waveband of interest, the distance S between the longitudinal centerlines of adjacent tubes 28 should be no more than about one eighth wavelength of sound in air at the lower limit 55 Hz frequency. Then, the beneficial phase-cancellation effect occurs at the very low frequencies. On the other hand, the centerline to centerline distance S should be at least one sixth wavelength of sound in air at the highest frequency of interest (110 Hz), to allow the incident sound waves to "see" a substantial reflective area on the wall 12 (greater than the tube area) within about one sixth wavelength of each tube center. Ordinarily, there should be about two inches between the walls of adjacent tubes.

It should be noted that the acoustical effects which are strong under particular conditions (e.g., at one fourth wavelength) are usually nearly as strong under nearly the same conditions. By selecting a bandwidth of interest having a lower limit which is one half the upper limit, the phenomena which are strongest at the higher frequencies tend to lose effect at lower frequencies and those which are strongest at the lower frequencies tend to lose effect at higher frequencies, and the result is that substantially uniform noise attenuation is achieved over a broad band. At frequencies up to half an octave below the band of interest, fairly good attenuation is effected, and the same is true at frequencies up to half an octave above the band of interest. Consequently, the effective bandwidth is approximately two full octaves.

The sound absorbing medium in the sound absorber 36 is effective at low frequencies and attenuates any narrow bands of sound which could leak through the otherwise reactive sound attenuator 10 in special situations. Accordingly, the sound absorber is helpful in attenuating sound although not essential. At frequencies above the bandwidth of interest, the sound absorber 36 is particularly effective, and it thus extends the effective range of attenuation. In addition, the sound absorber enhances the attenuation throughout the range where the reactive properties of the sound attenuator 10 are operative. At the high end of the reactive range, the sound absorber 36 attenuates sound travelling through the ducts between the reactive tube ends to thereby directly add to the reactive end effects. At the low end of the reactive range, the sound absorber has a lesser effect, but it still provides an indirect benefit in that it accelerates the attenuation of non-fundamental modes of propogation in the tubes, so that the beneficial end to end interaction more nearly approaches the theoretical limit. Between the frequencies where the reactive effects are targeted to work best (55 to 110 Hz) the sound absorber 36 raises the attenuation, and it also slightly broadens the bandwidth in the reactive range.

As previously suggested, it is possible to use the sound attenuator with good results in the absence of any sound absorbing medium such as the sound absorber 36. It is also possible to achieve sound attenuation by installing the tubes 28 on only one side of the wall 12 such as on the equipment room side. However, this one-sided arrangement provides only about half as much attenuation as a two-sided arrangement (although it takes 90% of the air pressure drop of a two-sided configuration), and this effectiveness reduction is not always acceptable. A short section can be cut from the center of the sound absorber 36 to accommodate a fire damper installed in the wall opening 34.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. Noise attenuating apparatus for inhibiting transmission of sound waves in a low frequency waveband between spaces on opposite sides of a wall, said apparatus comprising an array of tubes including at least three spaced apart tubes arranged on the wall parallel to one another and projecting from the wall into at least one of the spaces a distance of between one sixth and one third of a wavelength of sound in air at the highest frequency in the waveband, each tube being substantially circular in cross section and having a diameter less than approximately one sixth of a wavelength of sound in air at the highest frequency in the wavelength, and each tube having a cross sectional area substantially less than the corresponding cross sectional dimensions of the spaces.

2. Apparatus as set forth in claim 1, including a sound absorbing structure in each tube effective to absorb sound in the waveband.

3. Apparatus as set forth in claim 1, wherein each tube has a longitudinal centerline and the centerlines of adjacent tubes are spaced apart a distance of between about one sixth of a wavelength of sound in air at the highest frequency in the waveband and about one eighth of a wavelength of sound in air at the lowest frequency in the waveband.

4. Apparatus as set forth in claim 3, including a sound absorbing medium in each tube effective to absorb sound in the waveband.

5. Apparatus as set forth in claim 1, wherein each tube projects from the wall into both spaces and each tube has a length less than approximately one third of a wavelength of sound in air at the lowest frequency in the waveband.

6. Apparatus as set forth in claim 5, including a sound absorbing medium in each tube extending substantially the entire length thereof and effective to absorb sound in the waveband.

7. Apparatus as set forth in claim 5, wherein each tube has a longitudinal centerline and the centerlines of adjacent tubes are spaced apart a distance of between about one sixth of a wavelength of sound in air at the highest frequency in the waveband and about one eighth of a wavelength of sound in air at the lowest frequency in the waveband.

8. Apparatus as set forth in claim 7, including a sound absorbing medium in each tube effective to absorb sound in the waveband.

9. A wall mounted noise attenuating device for attenuating sound in a low frequency waveband defined between a lower limit frequency and a higher limit frequency, said device comprising:

at least three tubes each being substantially circular in cross section and each having a diameter less than approximately one sixth of a wavelength of sound in air at the higher limit frequency, each tube having a cross sectional area substantially less than the corresponding cross sectional dimensions of a space on opposite sides of the wall; and means for mounting said tubes on the wall at spaced apart locations with each tube oriented substantially perpendicular to the wall and each tube projecting from the wall into one of the spaces a distance of between one sixth and one third of a wavelength of sound in air at the higher limit frequency.

10. The invention of claim 9, including a sound absorbing medium in each tube effective to absorb sound in the waveband.

11. The invention of claim 9, wherein each tube has a longitudinal centerline and the centerlines of adjacent tubes are spaced apart a distance of between about one sixth of a wavelength of sound in air at the higher limit frequency and about one eighth of a wavelength of sound in air at the lower limit frequency.

12. The invention of claim 11, including a sound absorbing medium in each tube effective to absorb sound in the waveband.

13. The invention of claim 9, wherein each tube projects from the wall into both spaces and each tube has a length less than aproximately one third of a wavelength of sound in air at the lower limit frequency.

14. The invention of claim 13, including a sound absorbing medium in each tube extending substantially the entire length thereof and effective to absorb sound in the waveband.

15. The invention of claim 9, wherein the waveband has about 55 Hz as the lower limit frequency and about 110 Hz as the higher limit frequency.

16. Noise attenuating apparatus for inhibiting transmission of low frequency sound in a preselected waveband from a sound source on one side of a wall to an occupied space on the other side of the wall, said apparatus comprising:

first and second sets of tubes each including at least three tubes, each tube being substantially circular in cross section and having a diameter less than approximately one sixth of a wavelength of sound in air at the highest frequency in the waveband, each of said tubes having a cross sectional area substantially less than the corresponding cross sectional dimensions of the occupied space and a space containing the sound source;

means for mounting the tubes in said first set at spaced apart locations on said one side of the wall with each tube projecting from the wall into the space containing the sound source a distance of between one sixth and one third of a wavelength of sound in air at the highest frequency in the waveband; and means for mounting the tubes in said second set on said other side of the wall at locations aligned with the tubes in said first set and with each tube in said second set projecting from the wall into said occupied space a distance of between one sixth and one third of a wavelength of sound in air at the highest frequency in the waveband.

17. Apparatus as set forth in claim 16, wherein the occupied space includes a ceiling above an occupied area and the tubes in said second set are mounted at a location above the ceiling.

18. Apparatus as set forth in claim 16, including a sound absorbing medium in each pair of aligned tubes extending substantially the entire length presented by the pair of tubes together.

19. Apparatus as set forth in claim 16, wherein each pair of aligned tubes has a longitudinal centerline and the centerlines of adjacent pairs of tubes are spaced apart a distance of between about one sixth of a wavelength of sound in air at the highest frequency in the waveband and about one eighth of a wavelength of sound in air at the lowest frequency in the waveband.

20. Apparatus as set forth in claim 16, wherein the waveband is defined between about 55 Hz and about 110 Hz.

* * * * *